United States Patent [19]

Paxton, III

[11] Patent Number: 4,779,689

[45] Date of Patent: Oct. 25, 1988

[54] SOIL AUGER

[75] Inventor: Frank Paxton, III, Mission Woods, Kans.

[73] Assignee: Bulb Bopper, Inc., Mission Woods, Kans.

[21] Appl. No.: 101,426

[22] Filed: Sep. 28, 1987

[51] Int. Cl.[4] ..... E21B 10/00

[52] U.S. Cl. ..... 175/403

[58] Field of Search ..... 73/864.44, 864.43, 864.45; 175/58, 403, 62, 331, 332, 333, 338, 348, 349, 377; 408/204, 205; 294/50.7

[56] References Cited

U.S. PATENT DOCUMENTS

| | | | |
|---|---|---|---|
| 52,180 | 1/1866 | Leeds et al. . | |
| 127,150 | 5/1872 | Cook . | |
| 583,317 | 5/1897 | Wilson . | |
| 684,010 | 10/1901 | Thalheimer . | |
| 759,662 | 5/1904 | Bruner . | |
| 969,701 | 9/1910 | Jaynes . | |
| 1,785,120 | 12/1930 | Harding | 175/333 |
| 2,346,220 | 4/1944 | Kienzle et al. | 73/864.44 |
| 2,524,570 | 10/1959 | Phipps | 175/403 |
| 2,573,462 | 10/1951 | Lindsey | 408/204 |
| 2,666,330 | 1/1954 | McAndrew | 73/864.44 |
| 2,963,785 | 12/1960 | Dilling | 73/864.44 |
| 2,987,922 | 6/1961 | Harrington | 73/864.44 |
| 3,273,930 | 9/1966 | Gottfried | 73/864.44 |
| 3,331,455 | 7/1967 | Anderson, Jr. et al. | 175/403 |
| 3,356,168 | 12/1967 | Johnson . | |
| 3,847,227 | 11/1974 | Myers | 175/403 |
| 3,865,055 | 2/1975 | Gilbaugh . | |
| 4,653,336 | 3/1987 | Vollweiler . | |

*Primary Examiner*—Tom Noland
*Assistant Examiner*—Robert R. Raevis
*Attorney, Agent, or Firm*—Hovey, Williams, Timmons & Collins

[57] ABSTRACT

A soil auger particularly useful for removing a quantity of soil as a plug is provided, and is particularly adapted for use with a portable electric drill. The auger body is substantially cylindrical with at least one open end and provides a balanced unit for use at high rotational speeds. A series of teeth at the lower margin of the auger are alternately inwardly and outwardly displaced from the plane of the cylinder. The teeth may extend completely around the lower margin or only a portion thereof. Offset apertures in the walls of the cylinder permit removal of the soil contained therein. A shaft is mounted at the end of the auger opposite the teeth and adapted to be coupled to a hand held electric drill. In operation, the soil auger enters the ground driven by the drill which rotates the auger. The teeth of the auger create a circular hole in the ground around a plug of soil, the plug of soil entering the interior of the auger body for subsequent removal.

7 Claims, 1 Drawing Sheet

SOIL AUGER

BACKGROUND OF THE INVENTION

1. Field of the Invention

A soil auger of simple yet highly effective construction, uniquely adapted for use with a portable electric drill. The soil auger has a tubular body with teeth projecting from the margin of its open end and a shaft extending from the opposite end. The body is balanced for use at the high rotation speeds of portable electric drills. Rotation of the auger results in the penetration of the teeth into the soil, and, once the desired depth of penetration is achieved, the auger may be removed along with the soil contained therein.

2. Description of the Prior Art

It is often desirable to quickly obtain a number of holes of the same diameter and depth in the ground in such tasks as gardening and fencing. A variety of methods for digging such holes are commonly employed, including shovels, post-hole diggers and hand-held bulb planters. Coring devices such as the combination soil auger and soil core sampler disclosed by U.S. Pat. No. 4,653,335 also are useful for producing holes in the ground. However, none of these devices are adapted to be used with a portable power source and thus must be manually operated, resulting in the need for increased time and effort by the user.

A power driven screw-type auger is disclosed in U.S. Pat. No. 3,356,168. However, this auger does not produce a uniform plug of soil for removal but rather distributes the soil around the edge of the hole it produces.

SUMMARY OF THE INVENTION

The problems above are in large measure solved by the present invention which provides a soil auger readily adapted for household use with an electric drill to create holes in the ground for planting seeds or flower bulbs, or for digging small post holes. That is, the soil auger is lightweight, portable, and easily used to remove soil from the ground, thereby creating a hole.

Broadly speaking, the soil auger includes a substantially cylindrical tubular body and a shaft adapted for insertion into a standard electrical drill. The body is provided with at least one aperture in the side for the removal of soil accumulated therein. At the lower margin of the body is a row of teeth to engage and penetrate the soil. The teeth are displaced alternately inboard and outboard of the plane of the body or alternatively provided with additional material on the teeth to provide a cut or kerf wider than the thickness of the body.

The teeth extend around substantially the entire margin of the open end. Further, the body is enclosed at the end opposite to the open, toothed end to provide greater torsional rigidity. The side wall of the body is advantageously constructed with a pair of opposed apertures which may extend substantially the entire length of the body, thereby permitting a plug of soil to be pushed from one of the apertures through the other aperturee and out of the body.

DESCRIPTION OF THE PREFERRED EMBODIMENT

Figure 1:
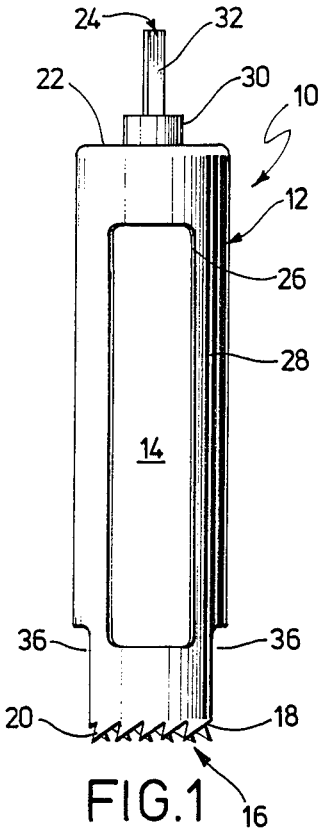
FIG. 1 is an elevational view of the soil auger in accordance with the present invention.

A soil auger 10, in accordance with the present invention, broadly includes cylindrical tubular body 12 which defines soil holding cavity 14 and terminates in an open end 16 which has a margin 18 from which project a plurality of teeth 20. A top, opposite end 22 of the body 12 is provided with a shaft 24 adapted for attachment to rotary drive means such as a portable electric drill.

In more detail, soil auger 10 is provided with body 12 which is of integral construction and includes at least one, and preferably two apertures 26 in the side wall 28. The body 12 is cylindrical and is provided with cavity 14 for the retention of soil after the desired penetration into the earth has been achieved. Further, the body is preferably constructed of steel to provide sufficient strength in order that the side walls 28 may be relatively thin. By keeping the thickness of the side walls less than $\frac{1}{8}''$, the body may be economically formed with the further advantage that a minimum dislodgement of soil will occur as the auger enters the ground.

Apertures 26 extend through side walls 28 along the major portion of the length between top end 22 and open end 16. The apertures 26 are directly opposed to maintain the auger 10 in dynamic balance as the auger 10 is rotated at high speed. When more than two apertures 26 are provided, they are equally spaced around the side wall 28. In the preferred embodiment, apertures 26 do not extend to lower margin 18, thereby providing a portion of side wall 28 to extend around the lower margin to provide additional rigidity.

Figure 4:
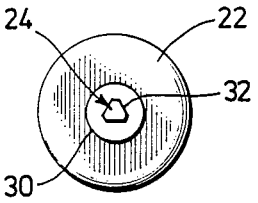
FIG. 4 is a top plan view of the soil auger as shwon in FIG. 3.
Figure 2:
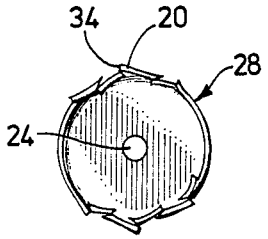
FIG. 2 is a bottom plan view of the soil auger shown in FIG. 1.
Figure 3:
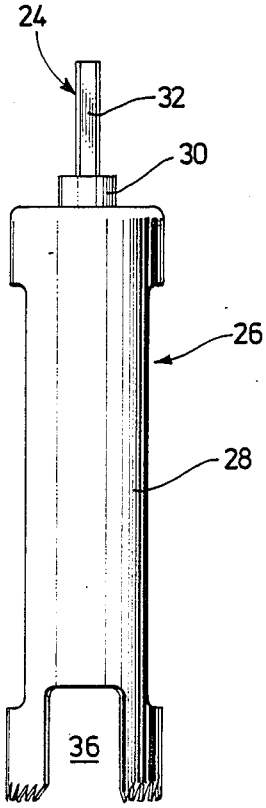
FIG. 3 is an elevational view of the soil auger shown in FIG. 1 and showing the portion thereof not fully shown in FIG. 1.
Figure 8:
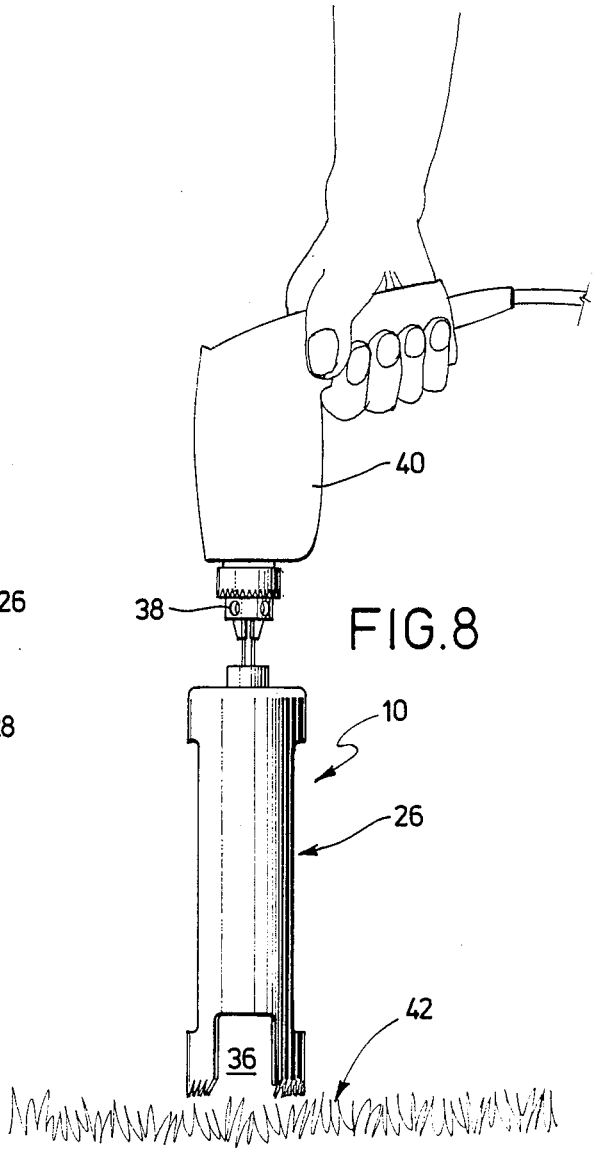
FIG. 8 is an elevational view of the soil auger shown in use coupled to a conventional electric drill.

Top end 22 mounts shaft 24 to body 12. Top end 22 is preferably enclosed to provide greater torsional rigidity between shaft 24 and body 12. Shaft 24 may be directly coupled to body 12, as by welding, and may be provided with a collar 30 for additional support. Alternatively, shaft 24 may be coupled to body 22 by an arbor or by nuts threaded on the shaft 24 above and below top end 22. Shaft 24 is preferably provided with three equally spaced flat surfaces 32 as shown in FIG. 4. The three flat surfaces 32 permit positive engagement of shaft 24 with the chuck of an electric drill.

Figure 5:
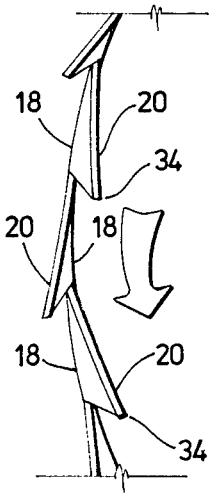
FIG. 5 is an enlarged fragmentary bottom plan view of the soil auger shown in FIG. 1 and showing the placement of the teeth on the lower margin of the body.

At the end opposite top end 22 of body 12 is open end 16. Open end 16 is defined by margin 18 of side wall 28 from which project a series of teeth 20. The teeth 20 are alternately angled inward and outward of the plane of side wall 28, as shown in detail in FIG. 5. Thus, the displacement of the teeth 20 is such that the cut or kerf made in the soil by the auger 10 is slightly wider than the thickness of the body 12. Alternately, the teeth 20 may be provided with additional material so that each tooth 20 is wider than the thickness of the side walls 28, or a lug or protuberance placed on a side of each tooth 20. The teeth are continuously serrated along margin 18 so that there is no location along the lower margin 18 which is not toothed. Each tooth 20 preferably extends no more than one half inch beyond the margin 18 and the space between teeth points 34 is preferably no great than ½", thus preventing binding of the auger when the auger 10 is coupled to a low-torque motor as is commonly found in household electric drills.

Figure 6:
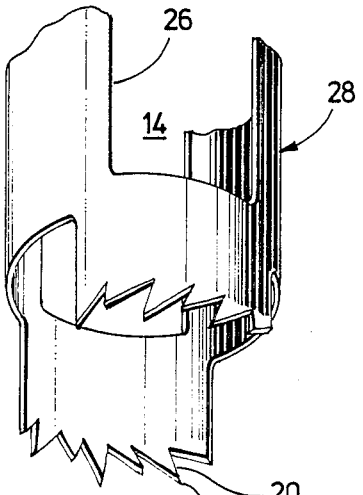
FIG. 6 is an enlarged fragmentary perspective view of the auger shown in FIG. 1 and showing the alignment of the teeth around the lower margin of the body.

Body 10 may be provided with a pair of opposed notches such as 36 extending into margin 18 as shown in detail in FIG. 6. The notches 36 assist in preventing the clogging of cavity 14 by heavy soils.

Figure 7:
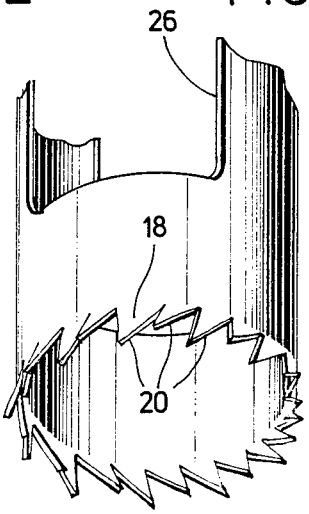
FIG. 7 is an enlarged fragmentary perspective view of an alternate embodiment of a soil auger in accordance with the present invention and having teeth extending around the entire perimeter of the lower margin of the body.

Alternatively, teeth 20 may extend around substantially the entire perimeter of margin 18 as shown in FIG. 7. This construction provides an additional number of teeth 20 which may increase the rate of soil penetration. To reduce clogging by heavy soils when the teeth 20 are arranged as in FIG. 7, apertures 26 may be extended to a location more proximate to the margin 18.

In operation, the soil auger 10 is coupled to the chuck 38 of electric drill 40. After the drill 40 is energized, the auger 10 is inserted vertically into the ground 42 to the desired level of penetration. Upon removal of the auger, a quantity of soil is retained in cavity 14. The soil may be removed through apertures 26 as loose soil or as a plug by pushing through apertures 26 in a downward direction on the plug and forcing it out open end 16. Thus, a series of holes may be easily driven.

I claim:

1. A soil auger comprising:

a cylindrical tubular body defining a cavity for receiving soil therein and a pair of opposed apertures in the sides thereof for discharging soil received in said cavity therethrough, said body having at least one open end;

said body having a margin defining the open end;

at least three adjacent teeth projecting from the margin, each tooth presenting a point proximate the point of an adjacent tooth to present a serration;

said teeth projecting downwardly from a portion of said margin, adjacent teeth being angled alternately inwardly toward and outwardly away from the cavity; and a shaft aligned with the axis of said body and secured to the end of the body opposite the open end, said shaft adapted for attachment to a chuck of a portable electric drill.

2. A soil auger as set forth in claim 1 wherein said body is enclosed at the end opposite said open end, said shaft being secured to said enclosed end.

3. A soil auger as set forth in claim 2 wherein said body defines a pair of untoothed opposed notches extending from said margin a portion of the distance between said margin and said enclosed end.

4. A soil auger as set forth in claim 3 wherein said opposed notches are displaced circumferentially around said body relative to at least some of said apertures.

5. A soil auger as set forth in claim 4 wherein the distance between said adjacent points is no greater than ½".

6. A soil auger as set forth in claim 4 wherein said teeth extend circumferentially around the entire margin.

7. A soil auger as set forth in claim 1 wherein said apertures extend substantially the length of said body.

* * * * *